United States Patent [19]

Oguni

[11] 4,244,274

[45] Jan. 13, 1981

[54] CYLINDER CONTROL DEVICE OF HYDRAULIC CYLINDER APPARATUS

[75] Inventor: Hiroshi Oguni, Akashi, Japan

[73] Assignee: Kawasaki Jukogyo Kabushiki Kaisha, Kobe, Japan

[21] Appl. No.: 63,658

[22] Filed: Aug. 3, 1979

[30] Foreign Application Priority Data

Aug. 14, 1978 [JP] Japan ..... 53-99189

[51] Int. Cl.[3] ..... F01L 25/06; F01B 7/18

[52] U.S. Cl. ..... 91/308; 91/318; 91/319; 91/321

[58] Field of Search ..... 91/308, 318–319, 91/321

[56] References Cited

U.S. PATENT DOCUMENTS

| | | | |
|---|---|---|---|
| 3,540,348 | 11/1970 | Pennther | 91/319 X |
| 3,916,765 | 11/1975 | Hilton | 91/308 X |
| 4,062,639 | 12/1977 | Conlee | 91/308 X |

FOREIGN PATENT DOCUMENTS

| | | | |
|---|---|---|---|
| 1260289 | 1/1972 | United Kingdom | 91/319 |
| 628301 | 9/1978 | U.S.S.R. | 91/319 |

*Primary Examiner*—Robert L. Bleutge
*Attorney, Agent, or Firm*—Jordan and Hamburg

[57] ABSTRACT

A cylinder control device of a hydraulic cylinder apparatus including a main directional control valve having a pilot chamber for controlling the reciprocatory movement of the piston, and a first valve including a plurality valve members for selectively communicating the pilot chamber, via an auxiliary directional control valve, to the fluid discharging tank side of the working fluid circuit when the piston reaches a predetermined position in its rearward stroke. The pilot chamber is brought into communication, via a passage, to the pump side of the working fluid circuit by a second valve when the piston reaches the end of its forward stroke. A control valve using the pump side pressure as a pilot pressure is mounted in the passage connecting the second valve to the pilot chamber or in the passage connecting the pilot chamber to the auxiliary directional control valve.

7 Claims, 2 Drawing Figures

CYLINDER CONTROL DEVICE OF HYDRAULIC CYLINDER APPARATUS

BACKGROUND OF THE INVENTION

This invention relates to improvements in a cylinder control device of a hydraulic cylinder apparatus capable of doing work of high magnitude.

In a hydraulic cylinder apparatus, the work done by a piston is given by the product of the working stroke of the piston, the effective pressure bearing area of the piston and the pressure of fluid acting on the piston. In a known hydraulic cylinder apparatus, difficulties have been encountered in maintaining the pressure in a working chamber defined by the piston and the cylinder body at a high level during the entire stroke of the piston, and thus it has been difficult to cause the piston to perform work of a high magnitude. Since the effective fluid pressure in the working chamber is produced by the load applied to the piston, the effective fluid pressure may be only produced near the dead point in the case of a hydraulic cylinder apparatus of the type wherein a load is applied to the piston near its dead point. Thus it is particularly difficult to cause a pressure of high level to be produced in the working chamber through the entire stroke of the piston in the case of the hydraulic cylinder apparatus of the aforesaid type.

In view of the foregoing, proposal has hitherto been made (Japanese Patent Application No. 53-93009, filed July 29, 1978) to use a cylinder control device which is capable of increasing the internal pressure of the working fluid chamber in the cylinder body above the internal pressures of the devices of the prior art, so as to enable the hydraulic cylinder to do work of a higher magnitude than has hitherto been done.

This invention is directed to a modification of the cylinder control device that has been proposed as described hereinbefore.

SUMMARY OF THE INVENTION

This invention has as its object the provision of a cylinder control device of a hydraulic cylinder apparatus capable of increasing the internal pressure of the working fluid chamber in the cylinder body so as to increase the magnitude of the work done by the hydraulic cylinder apparatus, the cylinder control device being particularly useful for varying the length of the stroke of the piston and the number of the strokes of the piston per unit time.

According to the invention, there is provided a cylinder control device of a hydraulic cylinder apparatus comprising a cylinder body, a piston arranged in said cylinder body for reciprocatory movement, a plurality of working fluid chambers defined by the cylinder body and the piston, a working fluid source, and a plurality of conduits for supplying working fluid from the working fluid source to the working fluid chambers and discharging working fluid therefrom to a fluid discharging place of a working fluid circuit, the cylinder control device comprising; a main directional control valve operative to control the supply of working fluid to the working fluid chambers and the discharge of working fluid therefrom to thereby switch the movement of the piston from one direction to the other direction, the main directional control valve having a pilot chamber containing working fluid therein for moving the main directional control valve between two positions when a change occurs in the pressure of working fluid in the pilot chamber which is connected to the fluid discharging place of the working fluid circuit; a control valve connected to the pilot chamber of said main directional control valve and movable between two positions or open and closed positions for causing the pressure in the pilot chamber to vary, the control valve being moved between the closed position and the open position by a change in the pressure in the conduit in communication with the working fluid source, and the pressure in the conduit in communication with the working fluid source being able to be raised to move the control valve from one position to the other position, thereby causing the pressure in the pilot chamber to vary and moving the main directional control valve from one position to the other position; and a first valve means interposed between the pilot chamber of the main directional control valve and the fluid discharging place of the working fluid circuit, said first valve means being operative to open when the piston reaches a predetermined position in its rearward stroke; wherein the improvement resides in that said first valve means comprises a plurality of valve members arranged axially of the piston, and wherein a auxiliary directional control valve is located in a passage connecting the first valve means to the pilot chamber of the main directional control valve for selectively actuating the valve members of the first valve means, the pressure in the pilot chamber being reduced when the selected valve members are opened and the pilot chamber communicates with the fluid discharging place, thereby moving the main directional control valve from one position to the other position.

Additional and other objects, features and advantages of the present invention will become apparent from the description of the embodiments set forth hereinafter when considered in conjunction with the accompanying drawing.

DESCRIPTION OF THE PREFERRED EMBODIMENTS

The drawings illustrate hydraulic cylinder apparatus controlled by the cylinder control device provided by the present invention. The hydraulic cylinder apparatus is operated by working fluid supplied from a working fluid source of a working fluid circuit.

Figure 1:
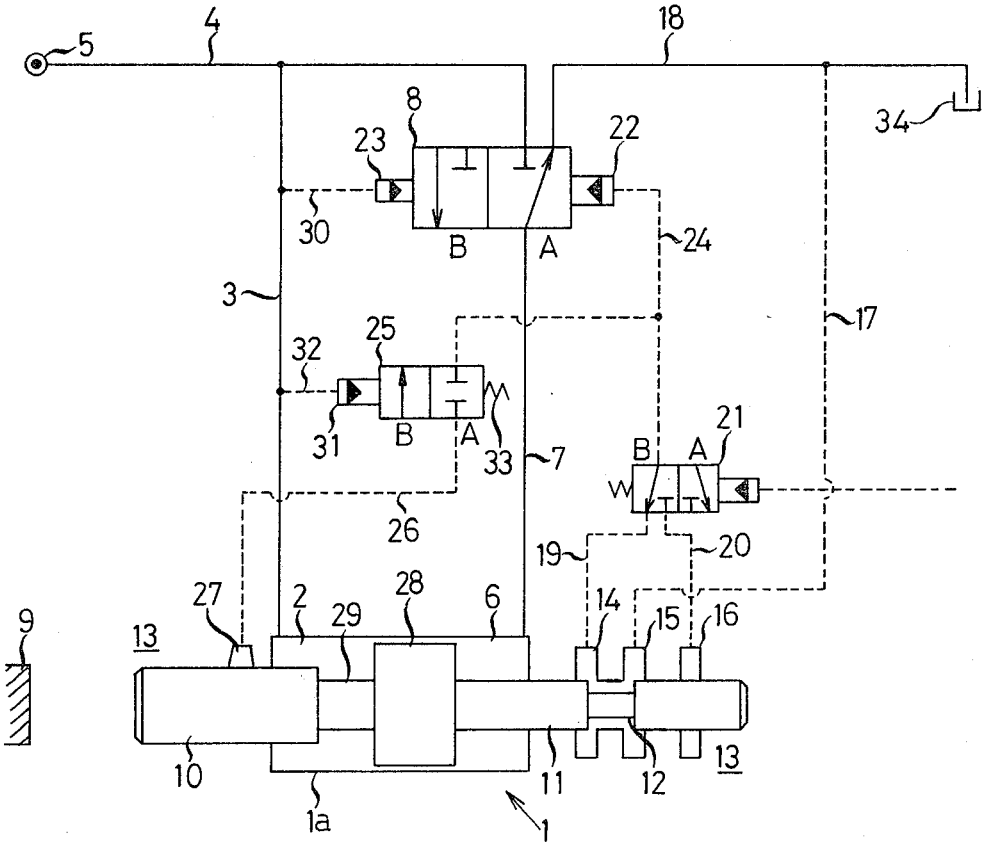
FIG. 1 is a circuit diagram of the hydraulic cylinder apparatus including a cylinder control device comprising one embodiment of the invention wherein the stroke of the piston is variable.
Figure 2:
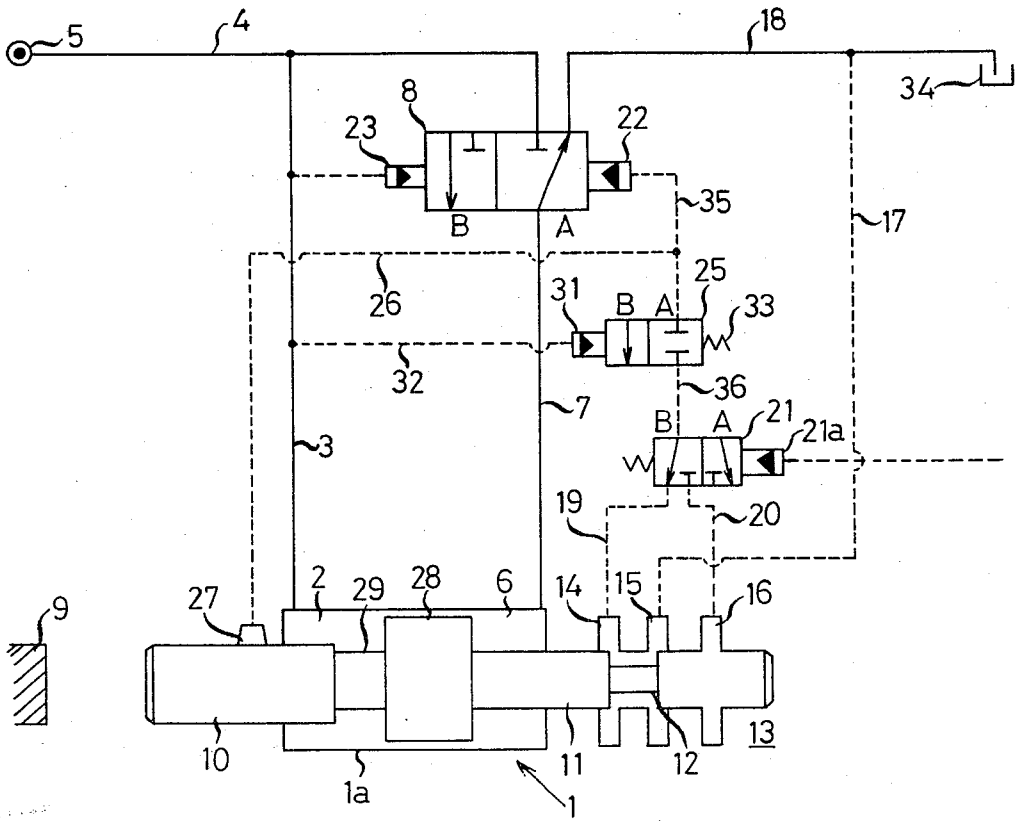
FIG. 2 is a circuit diagram of the hydraulic cylinder apparatus representing a modification in the embodiment of the cylinder control device shown in FIG. 1.

FIGS. 1 and 2 show embodiments wherein the pressure of working fluid in the working fluid chambers in the cylinder body can be raised and the stroke of the piston and the number of reciprocatory movements of the piston per unit time can be varied.

In FIG. 1, the numeral 1 designates a differential pressure hydraulic cylinder comprising a cylinder body 1*a*, and a piston 28 movable in reciprocatory movement in the cylinder body 1*a*. In this embodiment, the hydraulic cylinder 1 is in the form of a double-acting cylinder of the double rod type. The cylinder body 1*a* and piston 28 define working fluid chambers 2 and 6, one working fluid chamber 2 being connected through main conduits 3 and 4 to a working fluid source 5 having a pump, not shown, and the other working fluid chamber 6 being connected to the working fluid source 5 through a main conduit 7, three-port, two-position, directional control valve 8 (hereinafter referred to as a main directional control valve) and the main conduit 4. Working fluid is supplied to and discharged from each working fluid chamber through the main conduits. The piston 28 has attached thereto a piston rod 11 of a smaller diameter than a piston rod 10 disposed in spaced juxtaposed relation to an object 9 to be struck by the piston rod, the piston rod 11 of smaller diameter being formed at its forward end portion with an annular groove 12 for communicating two adjacent fluid chambers of three fluid chambers 14, 15, and 16 formed in the wall of the hole formed in a casing 13 for inserting the piston rod 11 and spaced apart from one another by a spacing interval equal to the width of the annular groove 12. The intermediate fluid chamber 15 communicates with a return passage 18 via a passage 17, while the other fluid chambers 14 and 16 communicate with a three-port, two-position, directional control valve 21 (hereinafter referred to as an auxiliary directional control valve) via passages 19 and 20 respectively. The fluid chambers 14, 15 and 16 and annular groove 12 constitute a first valve means of this embodiment. The return passage 18 communicates with a tank 34 which constitutes a fluid discharging place of the working fluid circuit.

The main directional control valve 8 has pilot chambers 22 and 23 differing from each other in pressure bearing area. The pilot chamber 22 of larger pressure bearing area is selectively connected to one of passages 19 and 20 via a passage 24 and the auxiliary directional control valve 21, and is also connected, via the passage 24 and a branch passage 26 mounting a control valve 25 therein, to a fluid chamber 27 formed in the wall of the hole formed in the casing 13 for inserting the piston rod 10. The control valve 25 is in the form of a two-port, two-position, directional control valve. When the piston 28 is disposed in the left end position in FIG. 1, the fluid chamber 27 is brought into communication with the working fluid chamber 2 by way of an annular groove 29 formed in the base of the piston rod 10. The fluid chamber 27 and annular groove 29 constitute a second valve means of this embodiment. The other pilot chamber 23 of the main directional control valve 8 communicates with the main conduit 4 via a passage 30. It is to be understood that the pilot chamber 23 may be replaced by a spring. The control valve 25 has a pilot chamber 31 communicating with the main conduit 3 via a passage 32. When the pressure of working fluid in the main conduit 3 exceeds the set pressure of a spring 33 of the control valve 25, the fluid chamber 27 is brought into communication with the pilot chamber 22 of the main directional control valve 8.

In operation, when the main directional control valve 8 is kept in its functional position A by the action of working fluid acting in the pilot chamber 22 and the piston 28 moves rightwardly in FIG. 1 (rearward stroke), communication between the working fluid chamber 2 and liquid chamber 27 is cut off by the piston rod 10. If the auxiliary directional control valve 21 is in its functional position B at this time, then the pilot chamber 22 is brought into communication with a tank 34 on the discharge side of the working fluid circuit via the passage 24, auxiliary directional control valve 21, passages 19 and 17 and return passage 18 as soon as the annular groove 12 brings the fluid chambers 14 and 15 into communication with each other, thereby moving the main directional control valve 8 to its functional position B. Also, when the auxiliary directional control valve 21 is kept in its functional position A by pilot instructions, the pilot chamber 22 of the main directional control valve 8 is brought into communication with the tank 34 as soon as the annular groove 12 brings the fluid chambers 15 and 16 into communication with each other, thereby switching the main directional control valve 8 to the functional position B. That is, the position of the piston 28 (upper limit position) at the end of its rightward stroke or rearward stroke can be selected by the operation of the auxiliary directional control valve 21, thereby enabling the operation stroke of the piston 28 to be varied.

Upon the main directional control valve 8 being switched to the functional position B, working fluid of high pressure is applied to opposite ends of the piston 28 and the piston moves leftwardly in FIG. 1 (forward stroke) due to the difference in pressure bearing area between the two ends of the piston, thereby closing the first valve means 12, 14, 15, 16. As the piston moves to its left end position in FIG. 1 (lower limit position) after vigorously impinging against the object 9 near the end of its leftward stroke, the annular groove 29 brings the fluid chamber 27 into communication with the working fluid chamber 2. At this time, when the pressure of working fluid in the main conduit 3 is below the set pressure of the spring 33 of the control valve 25, the control valve 25 cuts off communication between the fluid chamber 27 and pilot chamber 22 of the main directional control valve 8, so that the main directional control valve 8 is not switched and the piston 28 stops at its lower limit position. This causes the pressure of working fluid in conduits 3, 4 and 32 on the pump side to increase, and when the pressure of working fluid exceeds the set pressure of the spring 33 of the control valve 25, the control valve 25 moves to its functional position B, and the main directional control valve 8 is switched to its functional position A by the pressure of working fluid on the pump side which acts in the pilot chamber 22, thereby moving the piston 28 rightwardly in FIG. 1 (rearward stroke). Thus, the stroke of the piston 28 in rightward direction starts when the pressure in the conduits on pump side is higher than the set pressure of the spring 33, so that the pressure in the working fluid chamber 2 can be kept at a high level. If the pressure of working fluid in the main conduit 3 is higher than the set pressure of the spring 33 of the control valve 25 when the piston 28 reaches in its lower limit position, then the control valve 25 is in its functional position B. Thus the movement of the piston 28 to its lower limit position immediately switches the main directional control valve 8 to its functional position A. As described hereinabove, the piston 28 is moved rightwardly in FIG. 1 by working fluid of higher pressure than the set pressure of the spring 33 of the control valve 25 in the lower limit position. The aforesaid operation is repeated so that the piston 28 is moved in reciprocatory movement by working fluid of high pressure. In this case, the position of the end of the stroke in one direction is variable.

FIG. 2 shows a modification of the embodiment shown in FIG. 1 wherein the control valve 25 mounted in passage 26 of FIG. 1 is mounted in passage 35 (which corresponds to the numeral 24 in FIG. 1). Let us assume that the main directional control valve 8 is in its functional position A and the piston 28 moves rightwardly in FIG. 2 (rearward stroke). When the pressure of working fluid on the pump side rises above the set pressure of the spring 33 of the control valve 25 and the control valve 25 is switched to its functional position B, the pilot chamber 22 of the main directional control valve 8 is brought into communication with the tank 34 by way of passage 35, control valve 25, passage 36, auxiliary directional control valve 21, passage 19, fluid chamber 14, annular groove 12, fluid chamber 15, passage 17 and return passage 18, as soon as the annular groove 12 communicates the fluid chambers 14 and 15 with each other, if the auxiliary directional control valve 21 is in its functional position B, thereby switching the main directional control valve 8 to its functional position B. If the auxiliary directional control valve 21 is in its functional position A, then the pilot chamber 22 of the main directional control valve 8 is communicated with the tank 34 as soon as the annular groove 12 communicates the fluid chambers 15 and 16 with each other, thereby switching the main directional control valve 8 to its functional position B.

If the pressure of working fluid on the pump side falls below the set pressure of the spring 33 of the control valve 25 for some reason, then the control valve 25 is switched to its functional position A and communication between the passages 35 and 36 is cut off by the control valve 25, so that the piston 28 stops at its upper limit position wherein the annular groove 12 brings the fluid chambers 15 and 16 into communication with each other. This causes the pressure of working fluid in the conduits 4, 3 and 32 communicating with the pump to rise, and when the pressure of the working fluid rises above the set pressure of the spring 33 of the control valve 25, the control valve 25 is switched to its functional position B. In this case, if the auxiliary directional control valve 21 is switched to its functional position A beforehand, the pilot chamber 22 of the main directional control valve 8 is brought into communication with the tank 34 and the main directional control valve 8 is switched to its functional position B when the control valve 25 is switched to its functional position B as above mentioned. Alternatively, if the auxiliary directional control valve 21 is switched to its functional position B beforehand, the auxiliary directional control valve 21 is moved to its functional position A by the increasing of the pressure in a pilot chamber 21*a* of the auxiliary directional control valve 21 when the piston 28 stops at its upper limit position wherein the annular groove 12 brings the fluid chambers 15 and 16 into communication with each other. Therefore, also in this case, when the control valve 25 is switched to its functional position B, the pilot chamber 22 of the main directional control valve 8 is brought into communication with the tank 34 and the main directional control valve 8 is switched to its functional position B without trouble. Thus, switching of the directions of movement of the piston 28 does not take place when the pressure of working fluid in the conduits of the pump side is low, and the piston 28 has its direction of movement reversed only when the pressure in these conduits rises to a high level. The pressure in the conduits on the working fluid source side can be maintained at a high level.

Upon the main directional control valve 8 moving to its functional position B, working fluid of higher pressure than the set pressure of the spring 33 of the control valve 25 flows from the main conduits of the pump side into the working fluid chamber 6 and applies pressure to opposite ends of the piston 28. The piston 28 moves from the upper limit position toward the lower limit position due to the difference in pressure bearing area between the two opposite ends of the piston (forward stroke). Upon the piston 28 reaching the lower limit position, the annular groove 29 brings the fluid chamber 27 into communication with the main conduit 3. This causes the pressure of working fluid to act in the pilot chamber 22 and the main directional control valve 8 is switched to its functional position A, thereby moving the piston 28 rightwardly in FIG. 2.

The embodiment shown in FIG. 2 is distinct from the embodiment shown in FIG. 1 in that the pressure of working fluid acting on the piston 28 is checked when the piston 28 is in its upper limit position in the former while the pressure thereof is checked when the piston 28 is in its lower limit position in the latter. Like the embodiment shown in FIG. 1, the embodiment shown in FIG. 2 is capable of causing working fluid of high pressure to act on the piston 28 through the entire stroke thereof in causing same to move in reciprocatory movement.

As described hereinabove, the embodiments shown in FIGS. 1 and 2 are operative to check the pressure of working fluid acting on the piston at the end of one of the forward and rearward strokes of the piston, to ensure that the piston is driven by working fluid of a pressure higher than a predetermined pressure. This makes it possible to apply to the piston a high fluid pressure, thereby imparting kinetic energy of a high magnitude to the piston. It is possible to set at any level as desired the kinetic energy imparted to the piston by varying the set pressure of the spring of the control valve. Furthermore, according to the present invention, the position of the end of a stroke in one direction is variable. Therefore, it is possible to vary the distance covered by the reciprocatory movement of the piston and the number of reciprocatory movements of the piston with respect to the constant volume of working fluid.

What is claimed is:

1. A cylinder control device of a hydraulic cylinder apparatus comprising a cylinder body, a piston arranged in said cylinder body for reciprocatory movement, a plurality of working fluid chambers defined by the cylinder body and the piston, a working fluid source, and a plurality of conduits for supplying working fluid from the working fluid source to the working fluid chambers and discharging working fluid therefrom to a fluid discharging place of a working fluid circuit, the cylinder control device comprising:

a main directional control valve operative to control the supply of working fluid to the working fluid chambers and the discharge of working fluid therefrom to thereby switch the movement of the piston from one direction to the other direction, the main directional control valve having a pilot chamber containing working fluid therein for moving the main directional control valve between two positions when a change occurs in the pressure of working fluid in the pilot chamber which is connected to the fluid discharging place of the working fluid circuit;

a control valve connected to the pilot chamber of said main directional control valve and movable between two positions or open and closed positions for causing the pressure in the pilot chamber to vary, the control valve being moved between the closed position and the open position by a change in the pressure in the conduit in communication with the working fluid source, and the pressure in the conduit in communication with the working fluid source being able to be raised to move the control valve from one position to the other position, thereby causing the pressure in the pilot chamber to vary and moving the main directional control valve from one position to the other position; and a first valve means interposed between the pilot chamber of the main directional control valve and the fluid discharging place of the working fluid circuit, said first valve means being operative to open when the piston reaches a predetermined position in its rearward stroke;

wherein the improvement resides in that said first valve means comprises a plurality of valve members arranged axially of the piston, and wherein an auxiliary directional control valve is located in a passage connecting the first valve means to the pilot chamber of the main directional control valve for selectively actuating the valve members of the first valve means, the pressure in the pilot chamber being reduced when the selected valve members are opened and the pilot chamber communicates with the fluid discharging place, thereby moving the main directional control valve from one position to the other position.

2. A cylinder control device of a hydraulic cylinder apparatus as set forth in claim 1, further comprising second valve means operative to bring the pilot chamber of the main directional control valve into communication with the working fluid source at the end of the forward stroke of the piston.

3. A cylinder control device of a hydraulic cylinder apparatus as set forth in claim 2, wherein said second valve means is connected to the pilot chamber via a passage having said control valve mounted therein.

4. A cylinder control device of a hydraulic cylinder apparatus as set forth in claim 2, wherein the hydraulic cylinder apparatus further comprises a piston rod means connected to the piston, and a casing surrounding the piston rod means, and wherein the second valve means comprises a groove formed at the base of the piston rod means on the second valve means side, and a fluid chamber formed in the wall of an opening formed in the casing for inserting the piston rod.

5. A cylinder control device of a hydraulic cylinder apparatus as set forth in claim 1, wherein the control valve is mounted in a passage connecting the pilot chamber of the main directional control valve to the auxiliary directional control valve.

6. A cylinder control device of a hydraulic cylinder apparatus as set forth in claim 1, wherein the hydraulic cylinder apparatus further comprises a piston rod means connected to the piston, and a casing surrounding the piston rod means, and wherein the first valve means including a plurality of valve members operative to bring the pilot chamber of the main directional control valve into communication with the fluid discharging place comprises at least one groove formed in a piston rod means connected to the piston, and at least three fluid chambers located in spaced-apart relation on the wall of an opening formed in the casing for inserting the piston rod means, at least one of said fluid chambers being connected to the conduit of the working fluid circuit on the fluid discharging place side and the rest of the fluid chambers being connected to the auxiliary directional control valve for selectively actuating the valve members of the first valve means.

7. A cylinder control device of a hydraulic cylinder apparatus as set forth in claim 1, wherein the hydraulic cylinder apparatus is a double-acting hydraulic cylinder of the double-rod type.

* * * * *